US009474949B2

(12) United States Patent
Campbell et al.

(10) Patent No.: US 9,474,949 B2
(45) Date of Patent: Oct. 25, 2016

(54) GOLF BAG BASE

(71) Applicant: NIKE, Inc., Beaverton, OR (US)

(72) Inventors: Derek Campbell, Portland, OR (US); Christopher H. Pearson, Billings, MT (US); Randy Wolfe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 346 days.

(21) Appl. No.: 14/011,851

(22) Filed: Aug. 28, 2013

(65) Prior Publication Data

US 2013/0341221 A1 Dec. 26, 2013

Related U.S. Application Data

(62) Division of application No. 10/700,043, filed on Nov. 4, 2003, now Pat. No. 8,616,369.

(51) Int. Cl.

| | |
|---|---|
| ***A63B 55/04*** | (2006.01) |
| ***A63B 55/00*** | (2015.01) |
| *A45C 13/36* | (2006.01) |

(52) U.S. Cl.

CPC ..... *A63B 55/04* (2013.01); *A63B 55/00* (2013.01); *A63B 55/50* (2015.10); *A63B 55/53* (2015.10); *A45C 13/36* (2013.01); *Y10T 428/24025* (2015.01); *Y10T 428/249953* (2015.04); *Y10T 428/249991* (2015.04)

(58) Field of Classification Search

CPC ..... A63B 55/00; A63B 55/04; A63B 55/50; A63B 55/53; Y10T 428/24025; Y10T 428/249953; Y10T 428/249991; A45C 13/36

See application file for complete search history.

(56) References Cited

U.S. PATENT DOCUMENTS

| | | | | |
|---|---|---|---|---|
| 2,435,479 A * | 2/1948 | Thommen | A63B 55/00 206/315.8 |
| 2,437,405 A * | 3/1948 | Robinson | A45F 3/02 206/315.3 |
| 2,902,287 A | 9/1959 | Elias | |
| 3,292,633 A * | 12/1966 | Punzel | B42F 17/02 206/45.23 |
| 3,866,646 A | 2/1975 | Nevard | |
| 3,941,398 A | 3/1976 | Nelson | |
| 4,378,883 A * | 4/1983 | Profeta | B60R 9/10 150/167 |
| 4,834,235 A | 5/1989 | Solheim et al. | |
| 5,314,063 A | 5/1994 | Lee et al. | |

(Continued)

FOREIGN PATENT DOCUMENTS

| | | |
|---|---|---|
| GB | 377001 A | 7/1932 |
| JP | 2001-198250 A | 7/2001 |

(Continued)

OTHER PUBLICATIONS

Feb. 17, 2015—(TW) Official Letter—App 93133466.

(Continued)

*Primary Examiner* — Tri Mai

(74) *Attorney, Agent, or Firm* — Banner & Witcoff, Ltd.

(57) ABSTRACT

A golf bag is disclosed that includes base formed of a flexible material, such as a polymer foam material. The base is formed as a one-piece element, and the base may be flexible such that the golf bag is supportable in an upright position or an inclined position. A flexion line may be formed in the base to promote flexing or pivoting in a specific area, and wear elements may be added to an exterior surface of the base to impart wear-resistance.

14 Claims, 15 Drawing Sheets

(56) References Cited

U.S. PATENT DOCUMENTS

| | | | | |
|---|---|---|---|---|
| 5,501,328 | A | 3/1996 | Keller et al. | |
| D374,986 | S | 10/1996 | Dages | |
| 5,713,543 | A | 2/1998 | Ruth et al. | |
| 5,829,719 | A | 11/1998 | Han | |
| 5,934,624 | A * | 8/1999 | Suk | A63B 55/53 206/315.7 |
| 5,941,383 | A | 8/1999 | Cheng | |
| 5,975,292 | A * | 11/1999 | Sundara | A63B 55/53 206/315.3 |
| 5,996,789 | A | 12/1999 | Suggs et al. | |
| D422,791 | S | 4/2000 | Han | |
| 6,062,383 | A | 5/2000 | Han | |
| 6,098,797 | A | 8/2000 | Han | |
| 6,158,581 | A | 12/2000 | Hong | |
| 6,189,691 | B1 | 2/2001 | Sundara et al. | |
| 6,216,865 | B1 | 4/2001 | Maeng | |
| 6,298,988 | B1 * | 10/2001 | Wen-Chien | A63B 55/53 206/315.3 |
| 6,315,117 | B1 | 11/2001 | Han | |
| 6,325,208 | B1 | 12/2001 | Cheng | |
| 6,386,362 | B1 | 5/2002 | Cheng | |
| 6,390,295 | B2 | 5/2002 | Rhee | |
| 6,412,734 | B2 | 7/2002 | Lin | |
| 6,431,355 | B1 | 8/2002 | Miura et al. | |
| 6,450,334 | B1 | 9/2002 | Chang | |
| 6,564,937 | B1 | 5/2003 | Cheng | |
| 6,568,527 | B1 | 5/2003 | Te-Pin | |
| 6,634,497 | B1 | 10/2003 | Chang | |
| 6,637,497 | B2 | 10/2003 | Herron | |
| 6,648,137 | B2 * | 11/2003 | Hamamori | A63B 55/00 206/315.3 |
| 6,682,027 | B1 | 1/2004 | Chang | |
| 6,736,264 | B2 | 5/2004 | Yoshida | |
| 6,938,762 | B2 | 9/2005 | Cheng | |
| 2003/0168362 | A1 | 9/2003 | Yoshida | |
| 2004/0200746 | A1 | 10/2004 | Kang | |
| 2004/0238386 | A1 | 12/2004 | Cheng | |
| 2005/0072697 | A1 | 4/2005 | Yang | |

FOREIGN PATENT DOCUMENTS

| | | |
|---|---|---|
| TW | 348556 | 12/1998 |
| TW | 401830 U | 8/2000 |
| TW | 439520 U | 6/2001 |
| TW | 545268 U | 8/2003 |
| TW | 566209 | 12/2003 |
| TW | 571801 U | 1/2004 |
| TW | 584006 | 1/2004 |

OTHER PUBLICATIONS

International Preliminary Report on Patentability in related international application No. PCT/US2004/035791 mailed May 8, 2006.
Written Opinion in related international application No. PCT/US2004/035791 mailed Jul. 13, 2005.
Office action in related Taiwanese patent application 93133466 mailed Aug. 11, 2010.
Office action in related Taiwanese patent application 93133466 mailed Jun. 13, 2011.
Office action in related Taiwanese patent application 93133466 mailed Mar. 21, 2012.
Office action in related Taiwanese patent application 099144727 mailed May 18, 2011.
Office action in related Taiwanese patent application 099144727 mailed Oct. 28, 2012.
Office action in related Taiwanese patent application 099144728 mailed May 18, 2011.
Office action in related Taiwanese patent application 099144728 mailed Oct. 29, 2012.

* cited by examiner

GOLF BAG BASE

CROSS-REFERENCE TO RELATED APPLICATION

This application is a divisional of U.S. patent application Ser. No. 10/700,043 filed Nov. 4, 2003 and entitled "Golf Bag Base." The entire subject matter of the application is incorporated herein by reference.

BACKGROUND OF THE INVENTION

1. Field of the Invention

The present invention relates to bags or other devices for transporting golf clubs. The invention concerns, more particularly, a golf bag having a flexible base that is formed as a one-piece element. The base has application to a golf bag with a support assembly for supporting the golf bag in an inclined position. The base also has application to golf bags that do not incorporate a support assembly.

2. Description of Background Art

The formal origins of the game of golf, one of the oldest international sports, dates to the 16$^{th}$ century at The Royal and Ancient Golf Club at St. Andrews, located in Scotland. During successive centuries, the game of golf has gained and maintained a populous following due to inherent challenges of the game, a respected reputation, and its suitability for relaxation. Due to an increasing growth in the number of individuals playing the game of golf, manufacturers of golf equipment, which includes golf clubs, balls, and footwear, regularly improve upon the various features and characteristics of the golf equipment. Golf equipment has, therefore, evolved over time to provide enhanced performance and suitability for a wide range of playing abilities and styles, with many of the advances relating to the configuration and materials that are utilized in the golf equipment.

Advancements in golf technology also apply to golf bags, which originally included a simple, hollow body and a strap. Golf clubs and other golf equipment were stored within the body and the strap was utilized to carry the golf bag and equipment around a golf course. Modern golf bags, however, are designed to efficiently organize the golf equipment, and provide a comfortable means of carrying the golf equipment. Furthermore, many modern golf bags, particularly carry bags, permit the golf bag to rest upon the ground in either an upright position or an inclined position, as described in greater detail below.

During the game of golf, an individual repeatedly carries a golf bag from one location to another location, and sets the golf bag upon the ground at each location. A conventional golf course includes numerous types of terrain, such as rolling hills, various areas of grass, sandtraps, and waterways. In many locations, therefore, a golf bag may be placed upon an uneven, unstable, or sloping area of ground, and the golf bag may not have the stability to remain in an upright position without additional support. Many golf bags include support assemblies in order to impart greater stability. For example, U.S. Pat. No. 5,829,719 to Han discloses a golf bag with a support assembly having a pair of legs, an actuator, and a pivoting plate. The legs are mechanically-coupled to the plate by the actuator. By extending the legs outward from the body of the golf bag, the plate pivots upward and the golf bag shifts to an inclined position, wherein the weight of the golf bag is cooperatively-supported by the legs and the plate. A similar golf bag configuration is disclosed in U.S. Pat. No. 6,062,383 to Han, wherein a portion of a base member pivots in place of the pivoting plate. U.S. Pat. No. 6,386,362 to Cheng discloses a golf bag having a support assembly with a pair of legs, an actuator, and a base. The base includes a front section and a rear section separated by a flexible material that permits the front section to pivot upward relative to the rear section.

SUMMARY OF THE INVENTION

The present invention is a golf bag having a body and a base. The body is substantially hollow, and the body includes a first end for receiving golf equipment and an opposite second end. The base is secured to the second end of the body and includes a one-piece element that extends substantially around the lower end of the body and forms a support surface for contacting the ground.

In one aspect of the invention, the base may define a flexion line such that a first portion of the base is pivotable with respect to a second portion of the base about the flexion line. The flexion line may be an indentation in the base that enhances flexibility along the indentation. In addition, sidewalls and a support surface of the base may exhibit reduced thickness to also facilitate pivoting of the first portion of the base with respect to the second portion.

In another aspect of the invention, one or more wear elements may be secured to an exterior surface of the base, and the wear elements may include a first wear element and a second wear element that are positioned on opposite sides of the base. In order to provide durability and wear-resistance, the wear elements may be formed from a rubber material.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
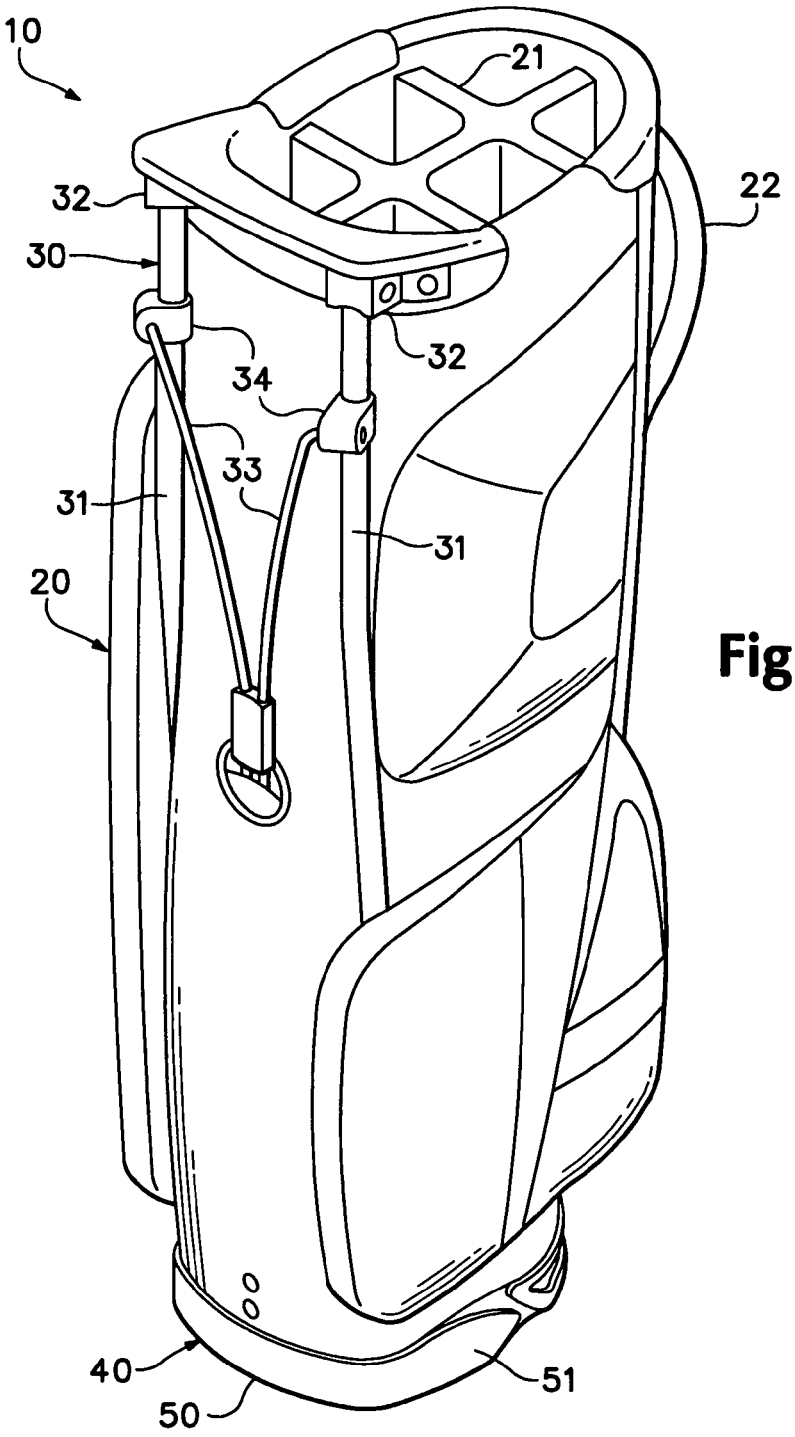
FIG. 1 is a perspective view of a golf bag having a base in accordance with the present invention.

The following discussion and accompanying figures disclose a golf bag 10 that is suitable for storing various types of golf equipment, such as golf clubs and balls, and transporting the golf equipment during the game of golf. The primary elements of golf bag 10, as depicted in FIGS. 1-4, include a body 20, a support assembly 30, and a base 40. Body 20 provides a structure that securely receives and organizes the golf equipment. Support assembly 30 and base 40 are secured to body 20 and cooperatively provide support and points of contact between golf bag 10 and the ground. As will be discussed in greater detail below, base 40 is formed as a one-piece element that flexes in cooperation with the operation of support assembly 30. Although the structure of base 40 is suitable for use with a golf bag that includes a structure similar to support assembly 30, base 40 may be applied to a variety of other golf bag styles and configurations.

Body 20 is a hollow structure, with a generally elongate and tubular configuration for receiving golf clubs. A variety of materials, textile or otherwise, may form the exterior of body 20, and pockets may be defined within the materials for receiving other types of golf equipment, including golf balls, tees, towels, and ball markers, for example. A divider 21 is secured at an upper end of body 20 and defines a plurality of apertures that provide access to the interior of body 20. In use by an individual, shafts of the golf clubs extend through the apertures and along the longitudinal length of body 20, whereas heads of the golf clubs remain accessible and on the exterior of golf bag 10. Divider 21, and particularly the apertures defined by divider 21, may be utilized to organize and prevent damage to the golf clubs. In this regard, divider 21 may be formed of a polymer material, and may have a foam and textile sheath, for example, to provide a yielding and protective surface for contacting the golf clubs. Divider 21 may also incorporate a partition (not depicted) that extends between a lower portion of divider 21 and base 40 to further segregate the volume within body 20 and separate the various golf clubs. In addition, a carrying strap (not depicted) may be secured to the exterior of body 20 to assist with carrying golf bag 10 and the associated golf equipment.

Figure 2A:
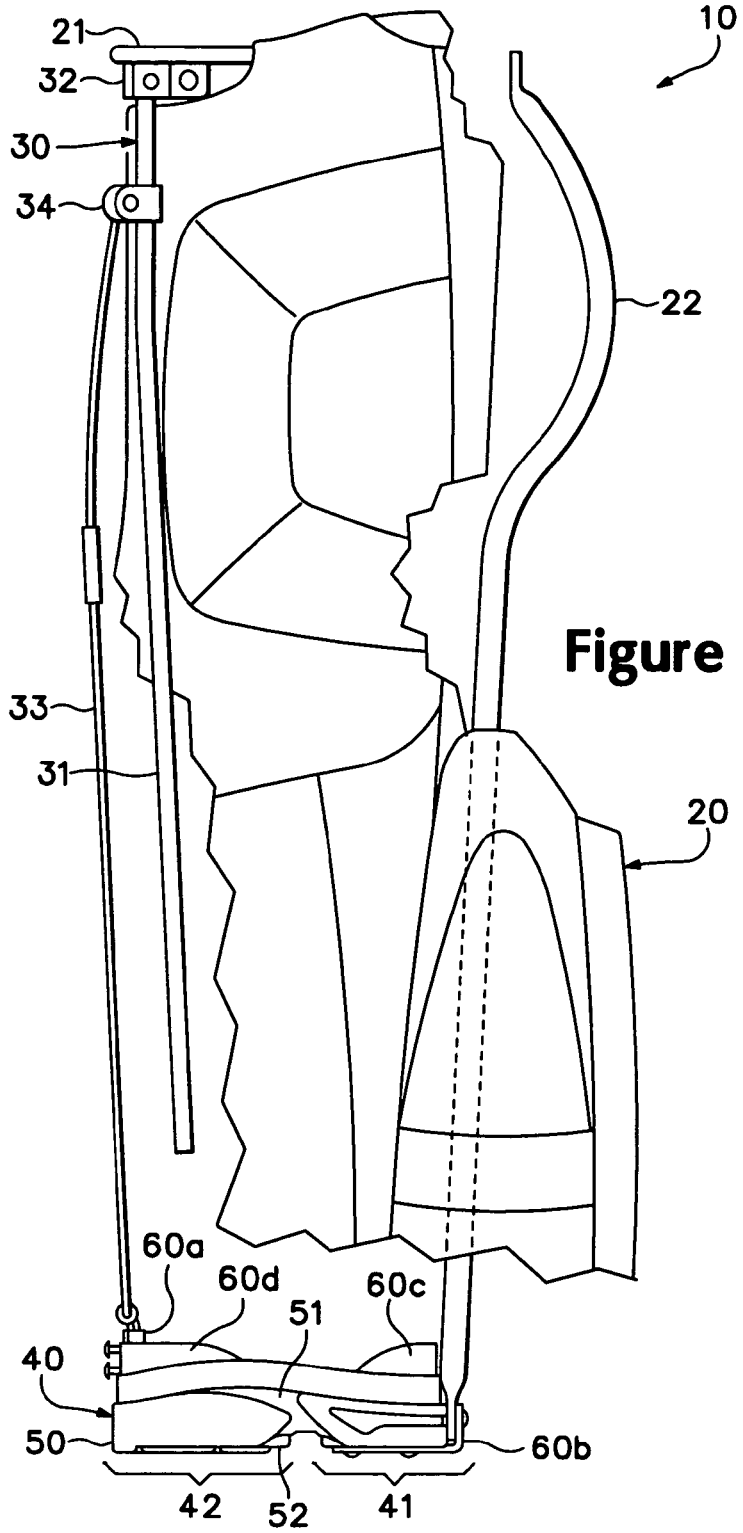
FIG. 2A is a cut-away elevational view of the golf bag.
Figure 2B:
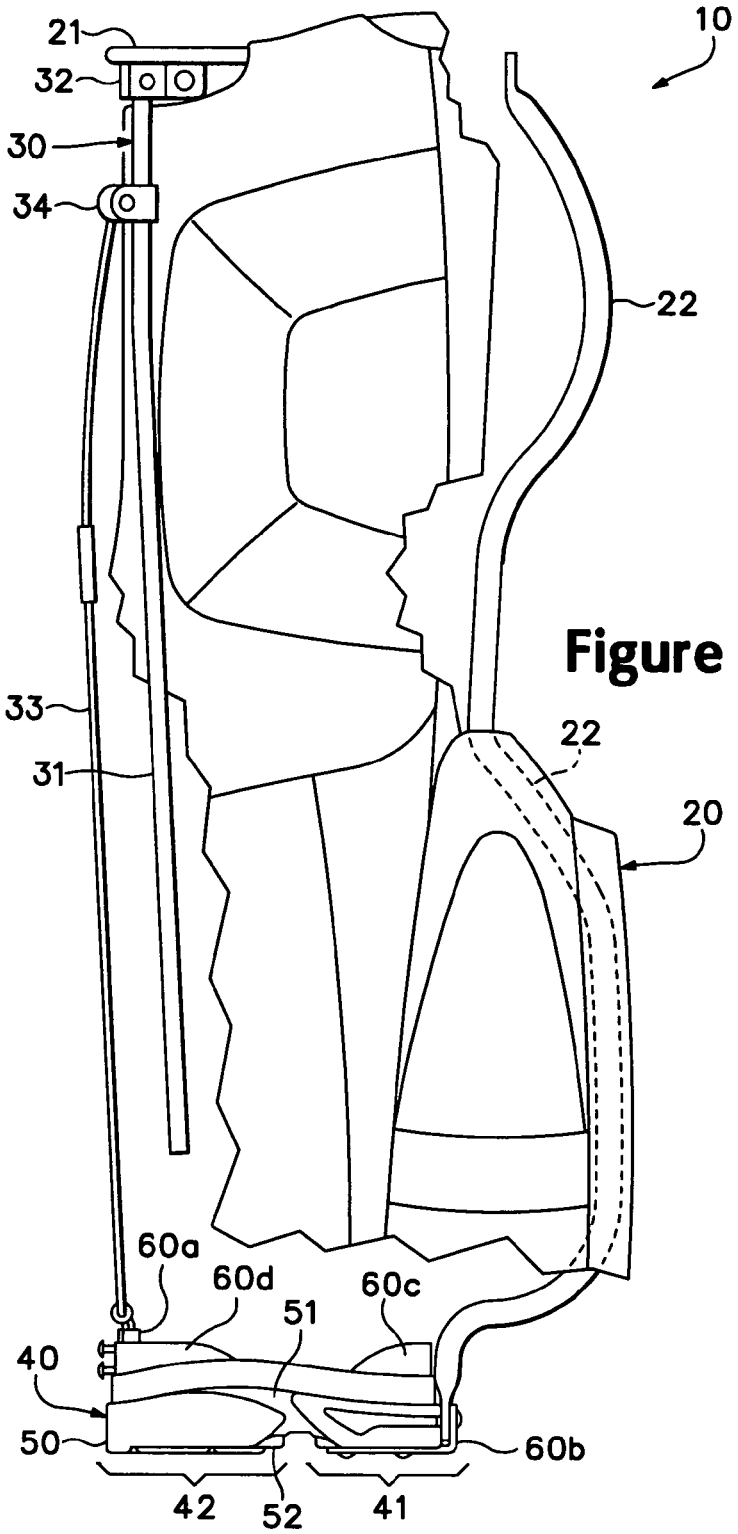
FIG. 2B is an alternate cut-away elevational view of the golf bag.

A semi-rigid frame 22 extends between divider 21 and base 40 to provide a supporting structure that retains the generally elongate and tubular configuration of body 20. As depicted in the figures, frame 22 has the configuration of a single shaft that extends along a side of body 20. In upper areas of golf bag 10, frame 22 is exposed, and the shaft forming frame 22 is curved to define a handle that assists with carrying golf bag 10 and provides a point of attachment for the carrying strap. In lower areas of golf bag 10, frame 22 extends into the materials that form the exterior of body 20. As depicted in FIG. 2A, lower portions of frame 22 are relatively straight and are secured to base 40. Alternately, frame 22 may also have a curved portion in the lower area, as depicted in FIG. 2B, in order to support the shape and limit collapse of the material elements that form pockets in body 20. That is, frame 22 may be curved to run adjacent to the exterior of body 20, thereby providing a rigid structure that assists with retaining the shape of body 20. Suitable materials for frame 22 include a variety of polymer materials, graphite, wood, fiberglass, and a lightweight metal, such as aluminum, for example. In further embodiments of the invention, frame 22 may have the configuration of multiple stay rods that extend between divider 21 and base 40.

Figure 3:
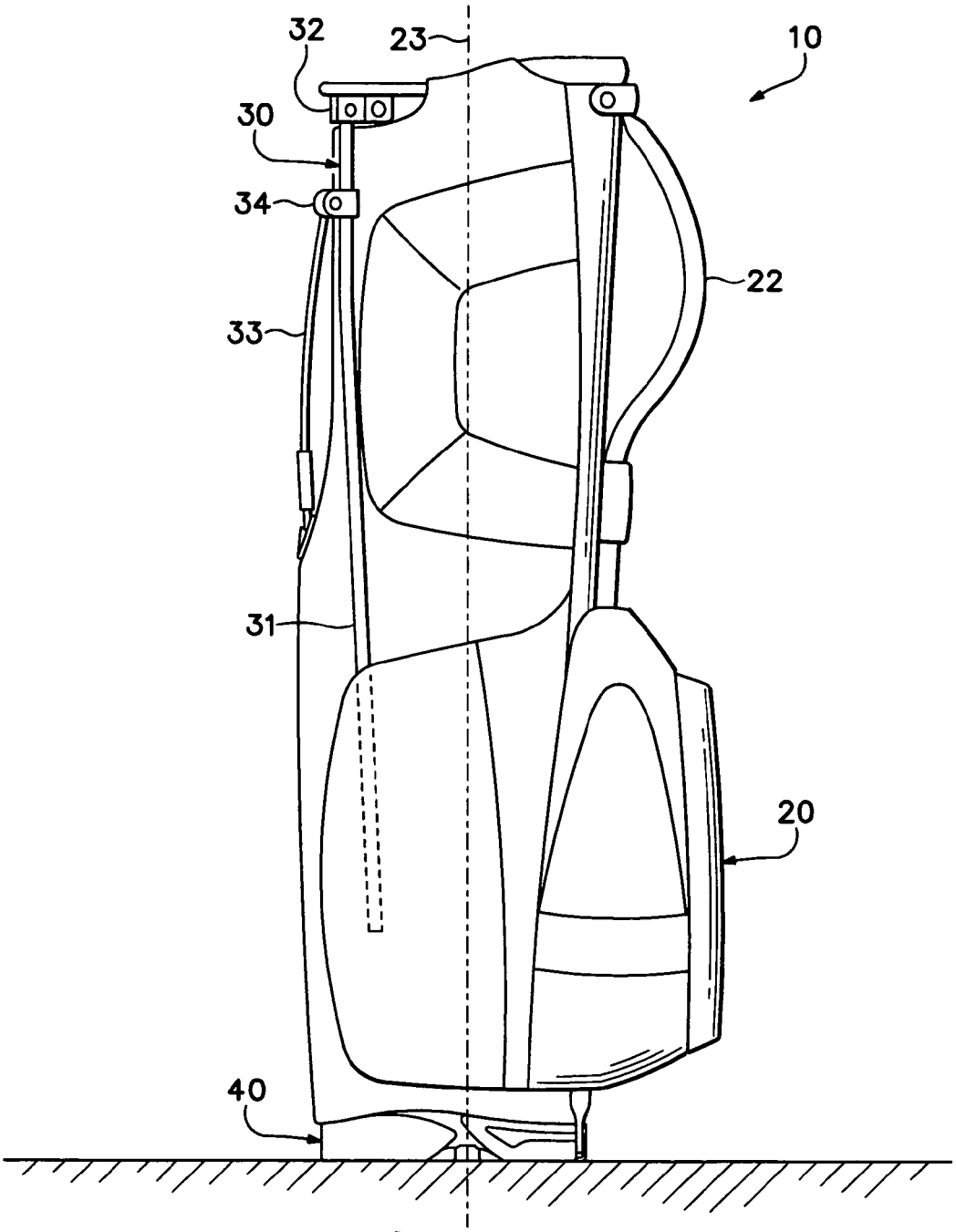
FIG. 3 is a side elevational view of the golf bag in an upright configuration.
Figure 4:
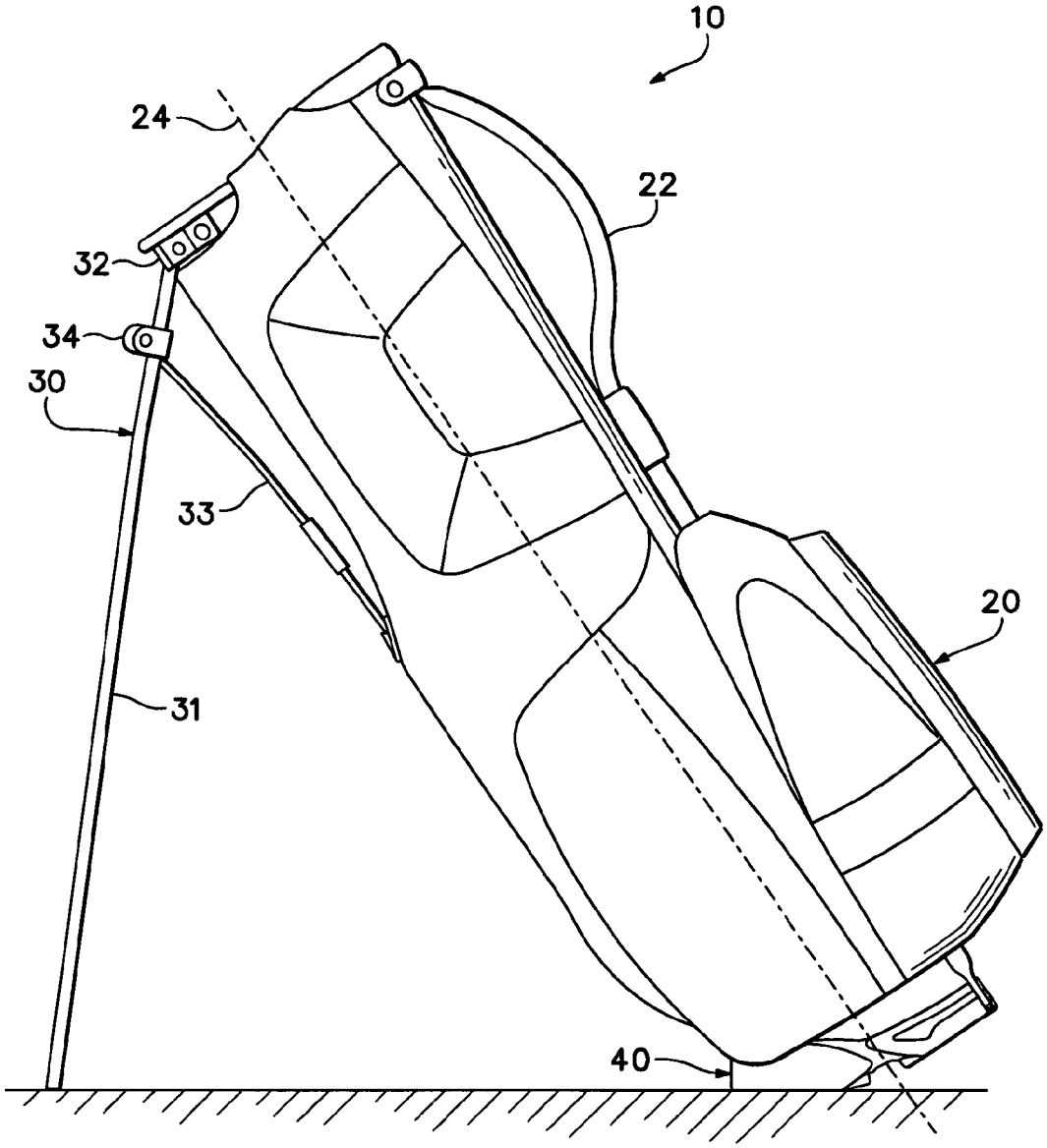
FIG. 4 is a side elevational view of the golf bag in an inclined position.

As an individual progresses around a golf course, golf bag 10 and the golf equipment located within body 20 are carried from one location to another location. At each location, the individual may place golf bag 10 upon the ground while selecting a suitable golf club and striking the golf ball. If a particular location is generally level and provides a stable surface, golf bag 10 may rest upon the ground in an upright position, as depicted in FIG. 3, wherein base 40 forms the primary point of contact between golf bag 10 and the ground. If a particular location is not level or will not provide a stable surface, golf bag 10 may rest upon the ground in an inclined position, as depicted in FIG. 4, wherein support assembly 30 and base 40 cooperatively form the points of contact between golf bag 10 and the ground.

Support assembly 30 includes a pair of legs 31, a pair of leg attachment points 32, an actuator 33, and a pair of actuator attachment points 34. Legs 31 are pivotally-secured to body 20 at leg attachment points 32, which may be formed integral with divider 21 or may be formed as a separate bracket that is attached to body 20 adjacent divider 21. An upper portion of actuator 33 is secured to each of legs 31 at actuator attachment points 34, which are spaced downward from leg attachment points 32. Actuator 33 extends downward from actuator attachment points 34 and along body 20. A portion of actuator 33 may extend through a sheath formed by the material of body 20, and a lower portion of actuator 33 is secured to base 40, as described below. See U.S. Pat. No. 6,386,362 to Cheng, which is hereby incorporated by reference.

Figure 5:
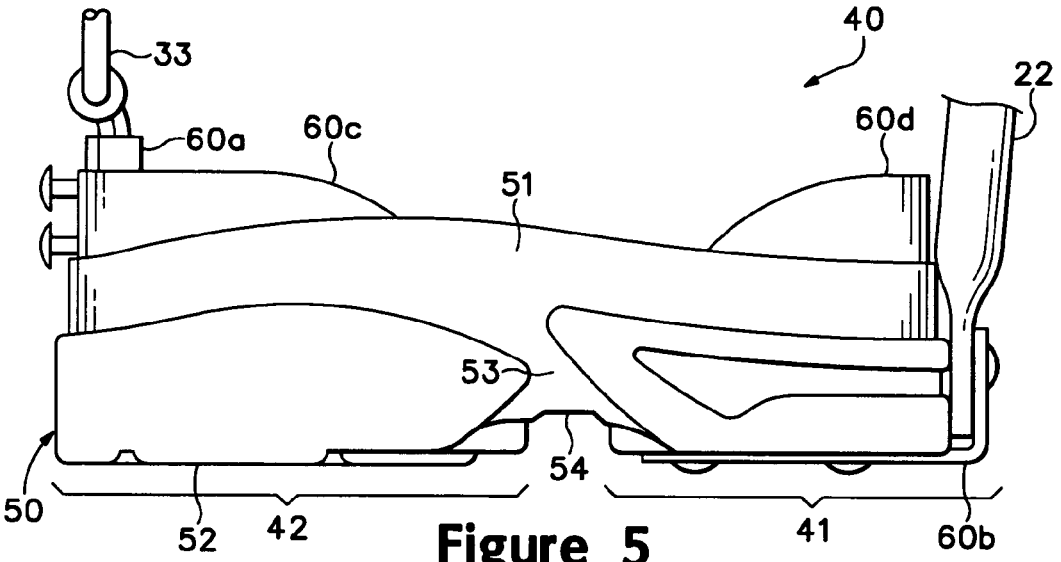
FIG. 5 is a side elevational view of the base in a non-flexed configuration that corresponds with the upright configuration of the golf bag depicted in FIG. 3.
Figure 6:
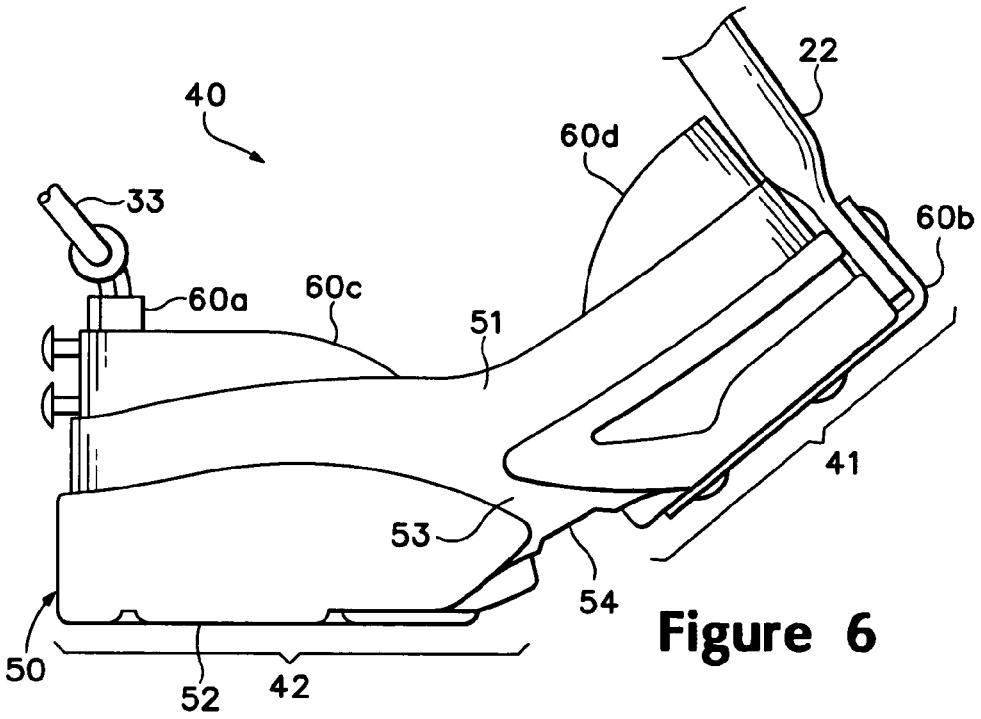
FIG. 6 is a side elevational view of the base in a flexed configuration that corresponds with the inclined configuration of the golf bag depicted in FIG. 4.
Figure 7:
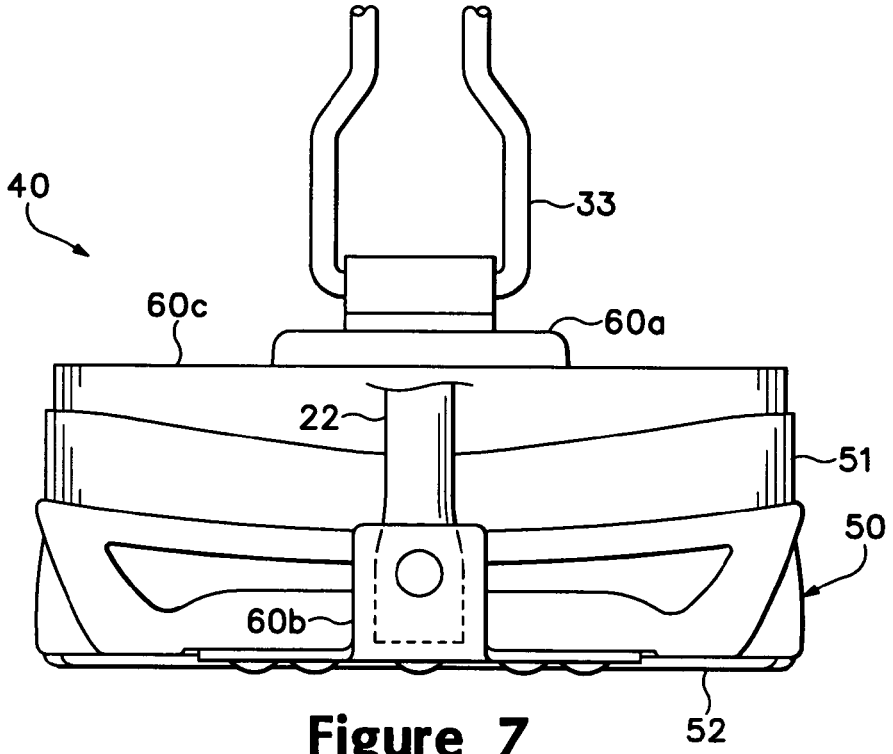
FIG. 7 is a front elevational view of the base.
Figure 8:
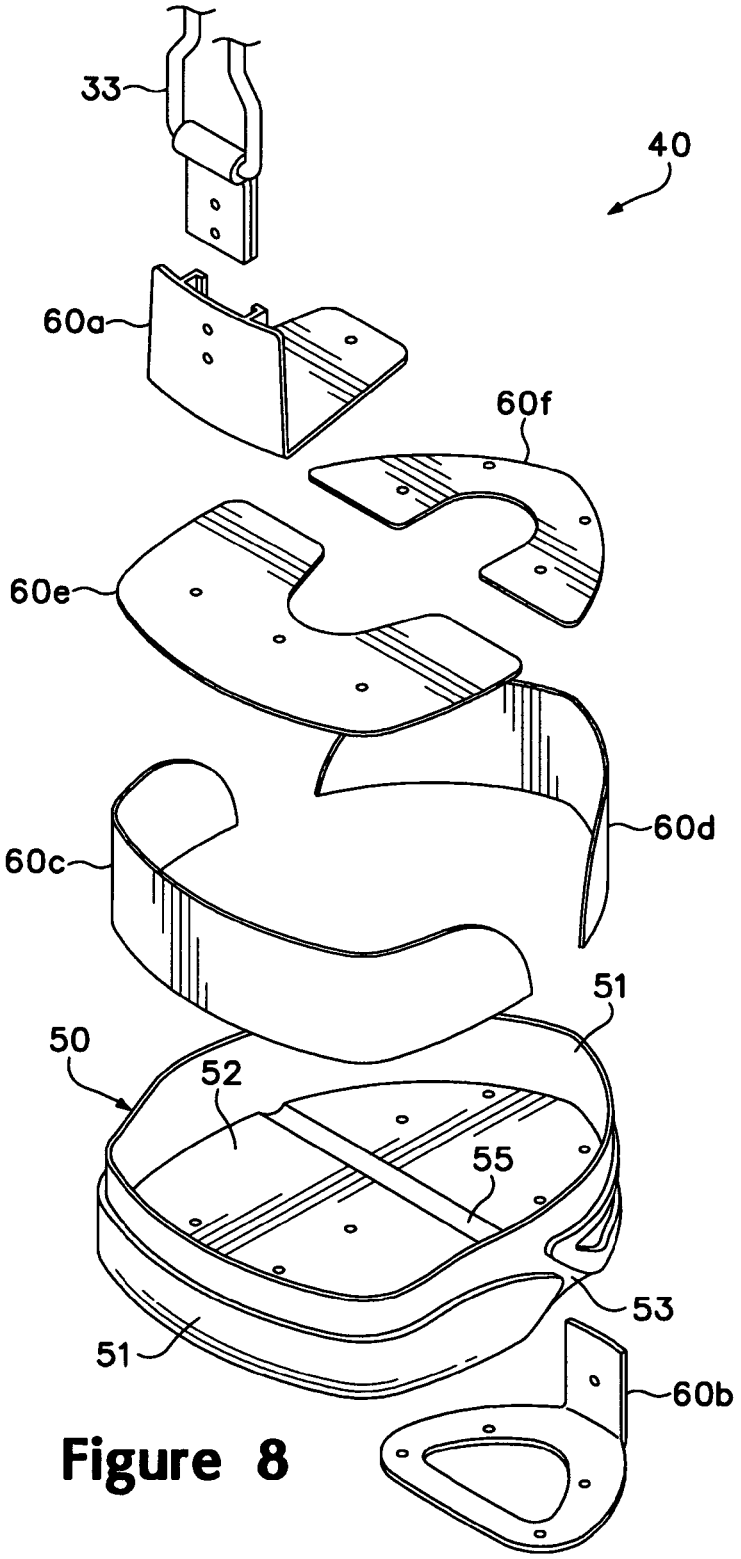
FIG. 8 is an exploded perspective view of the base.
Figure 9:
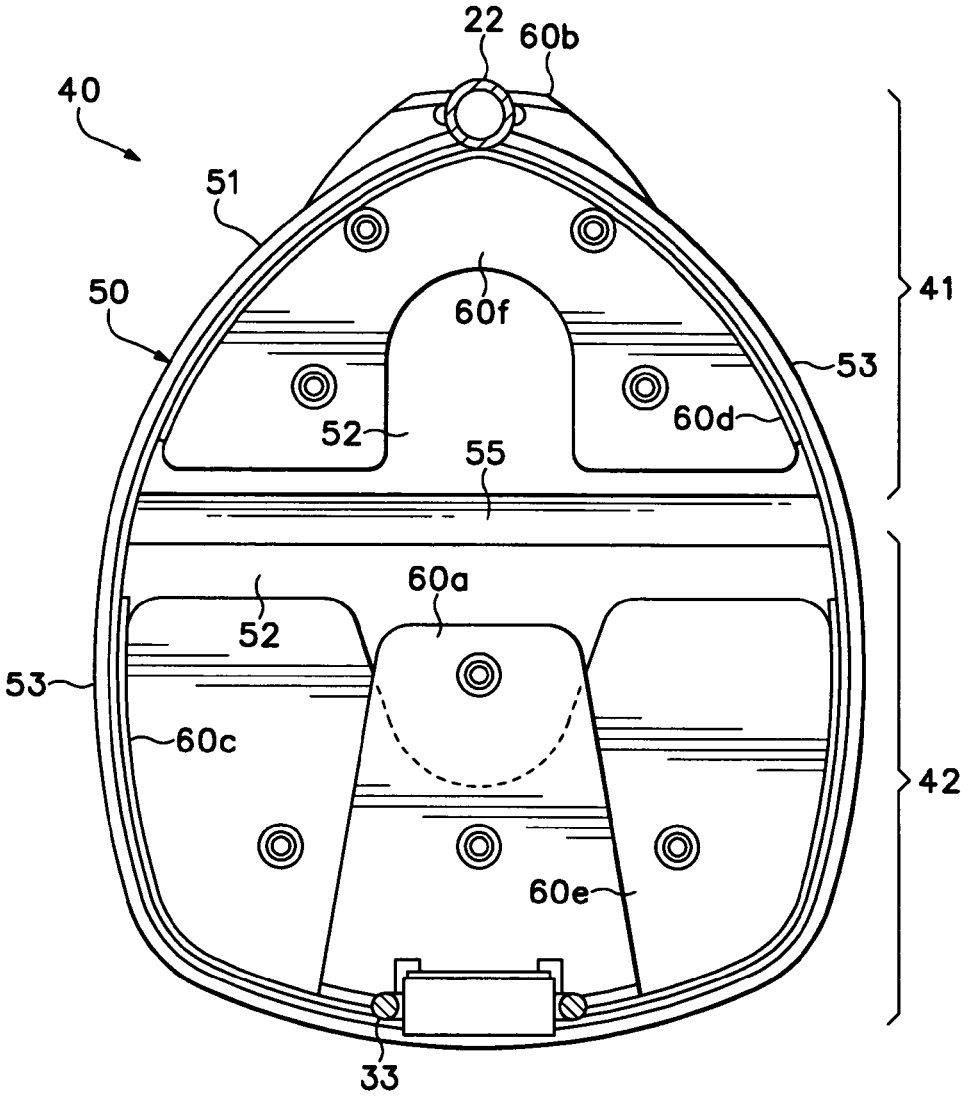
FIG. 9 is a top plan view of the base.
Figure 10:
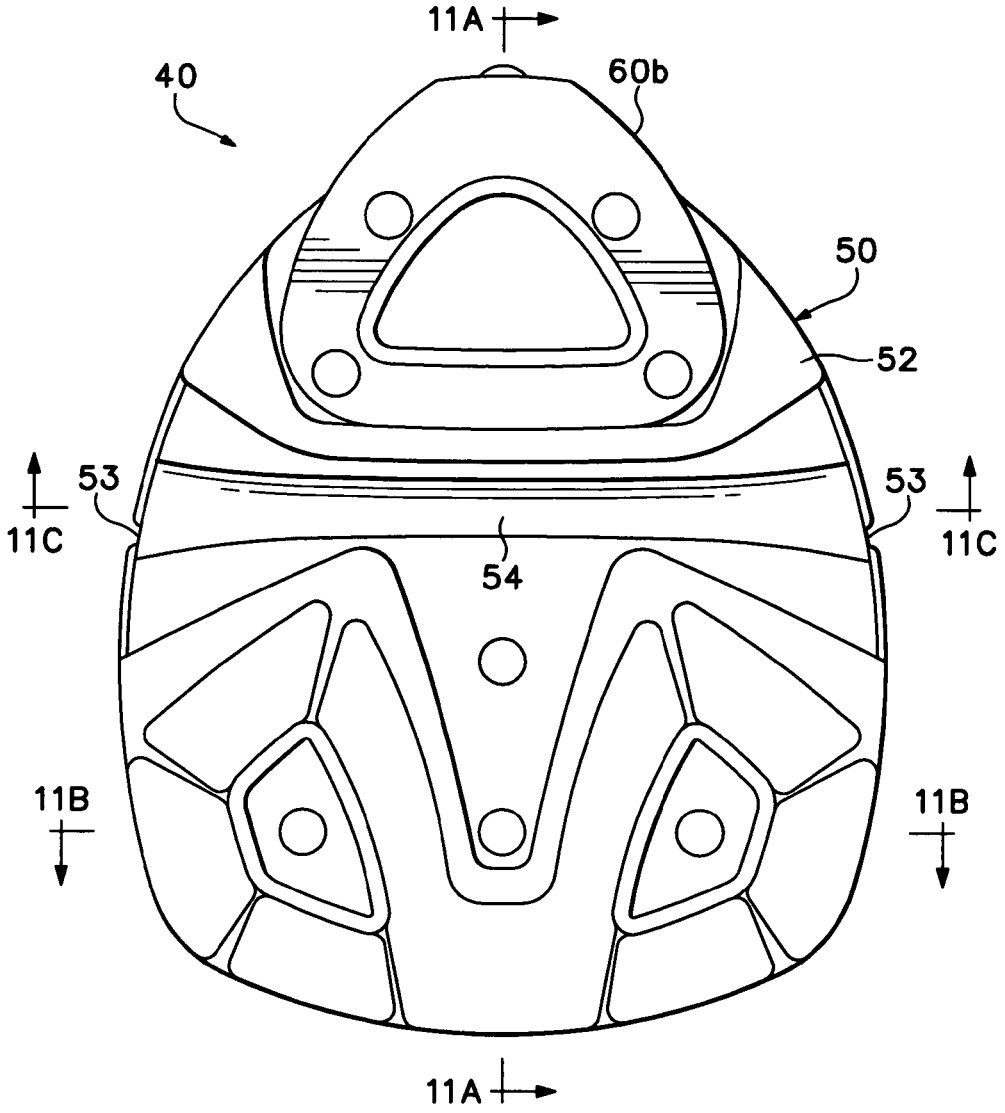
FIG. 10 is a bottom plan view of the base.
Figure 11A:
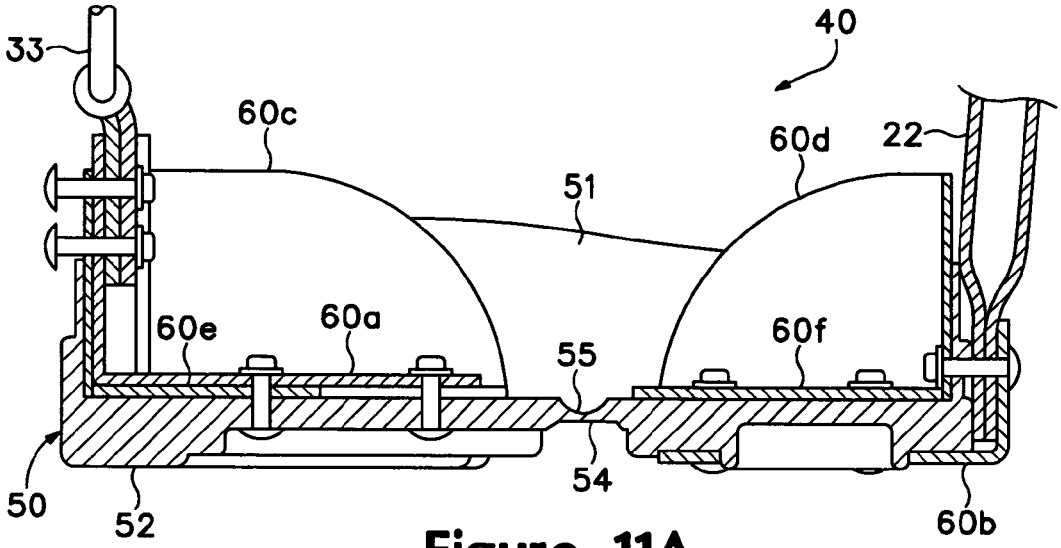
FIG. 11A is a first cross-sectional view of the base, as defined along section line 11A-11A in FIG. 10.
Figure 11B:
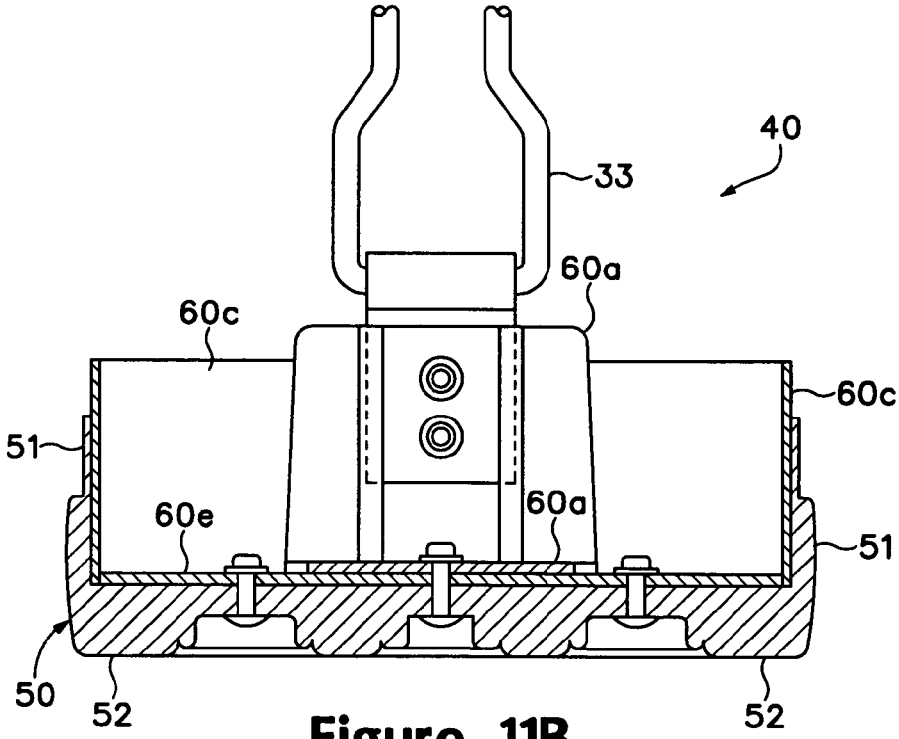
FIG. 11B is a second cross-sectional view of the base, as defined along section line 11B-11B in FIG. 10.
Figure 11C:
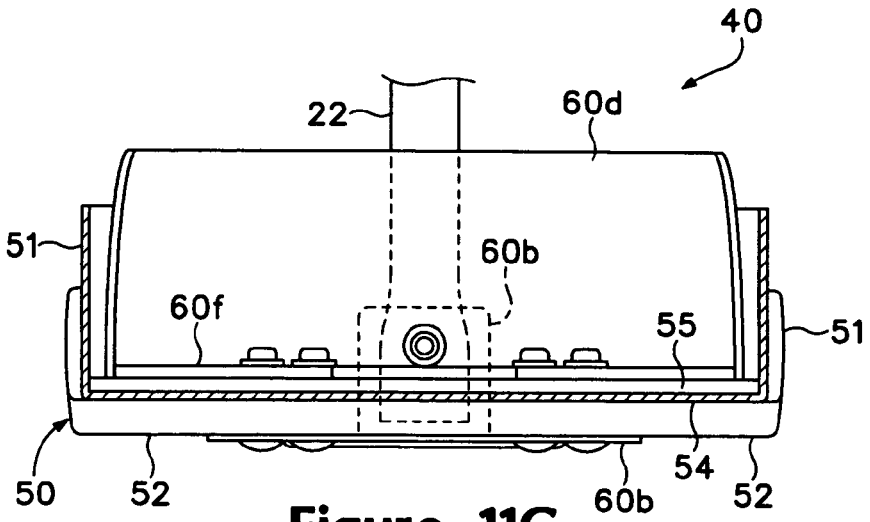
FIG. 11C is a third cross-sectional view of the base, as defined along section line 11C-11C in FIG. 10.
Figure 12:
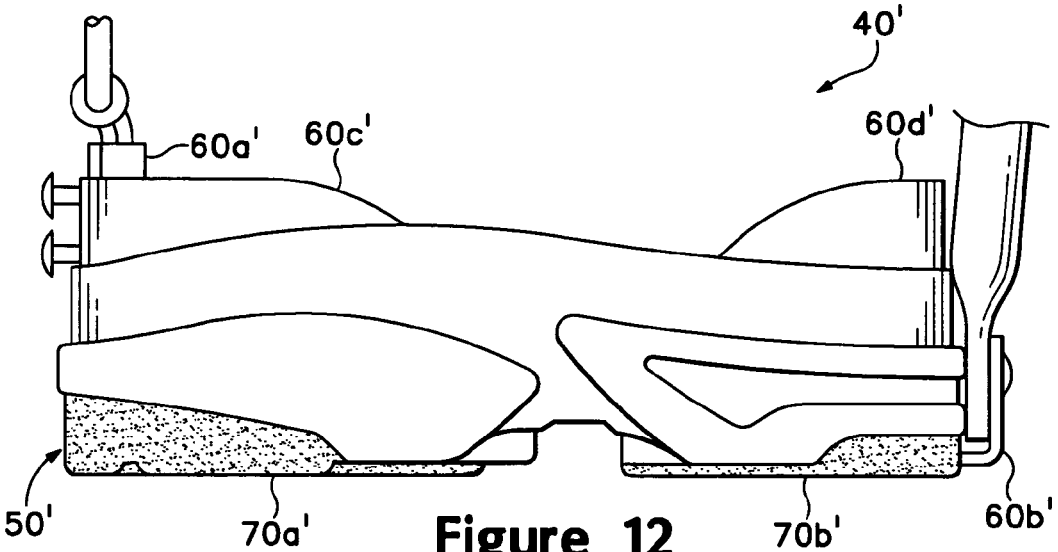
FIG. 12 is a side elevational view of another base in accordance with the present invention.
Figure 13:
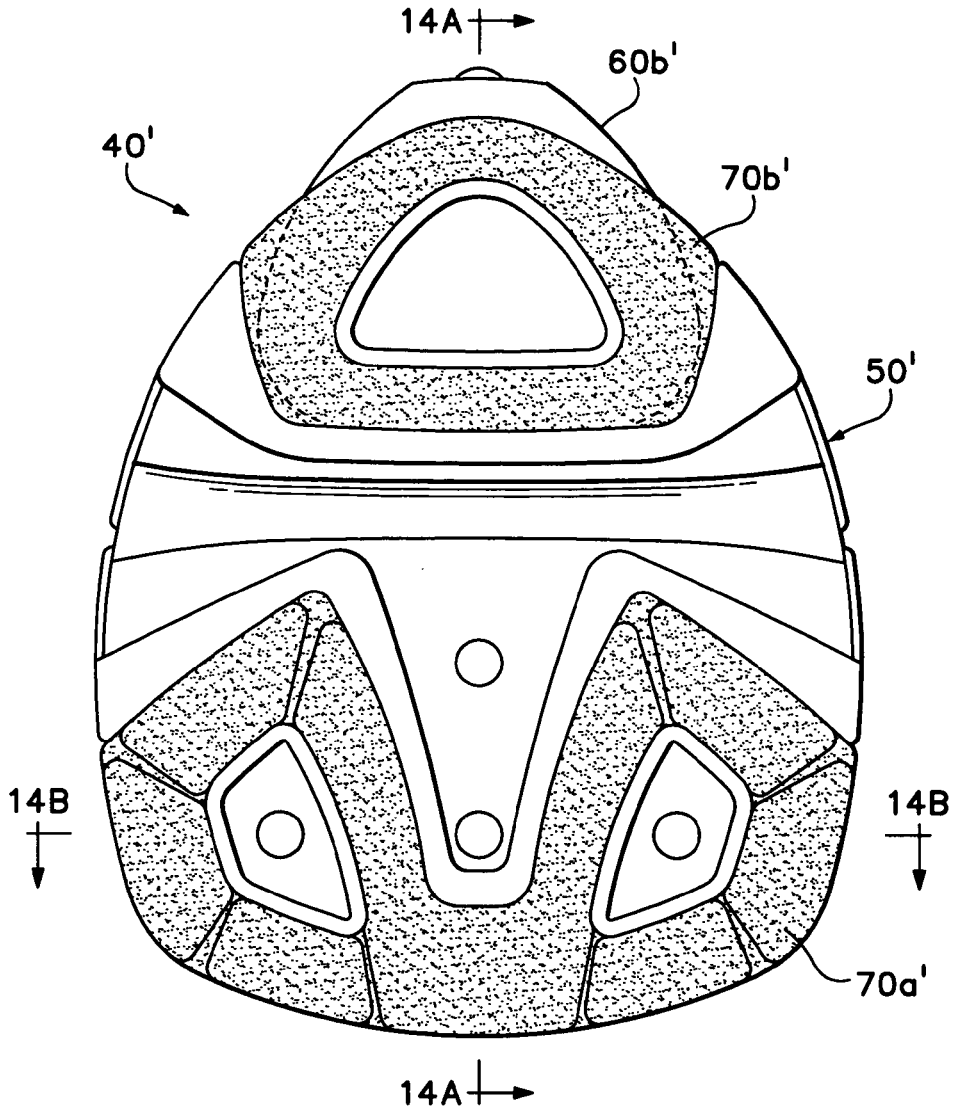
FIG. 13 is a bottom plan view of the base depicted in FIG. 12.
Figure 14A:
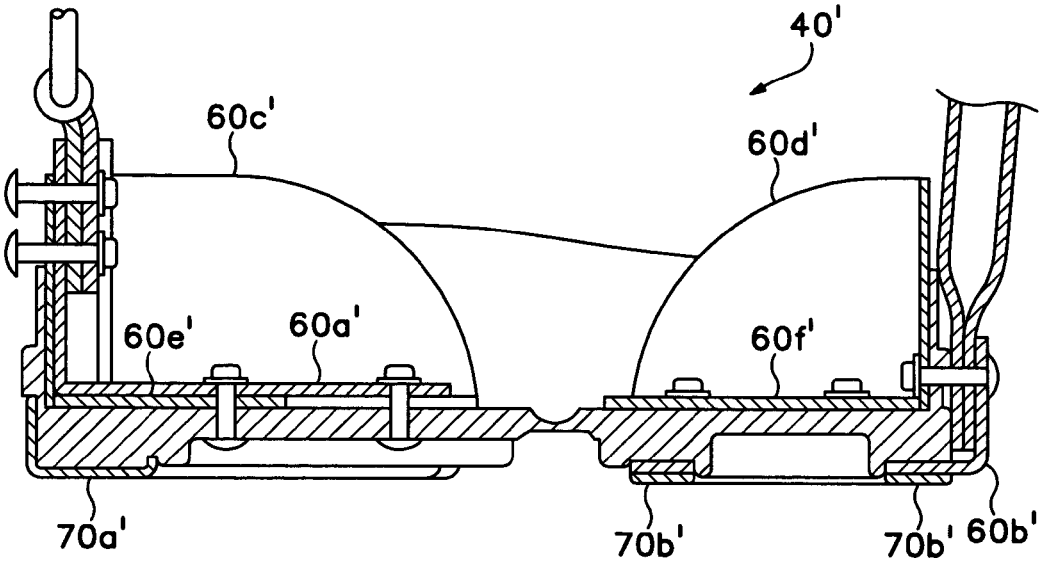
FIG. 14A is a cross-sectional view of the base depicted in FIG. 12, as defined along section line 14A-14A in FIG. 13.
Figure 14B:
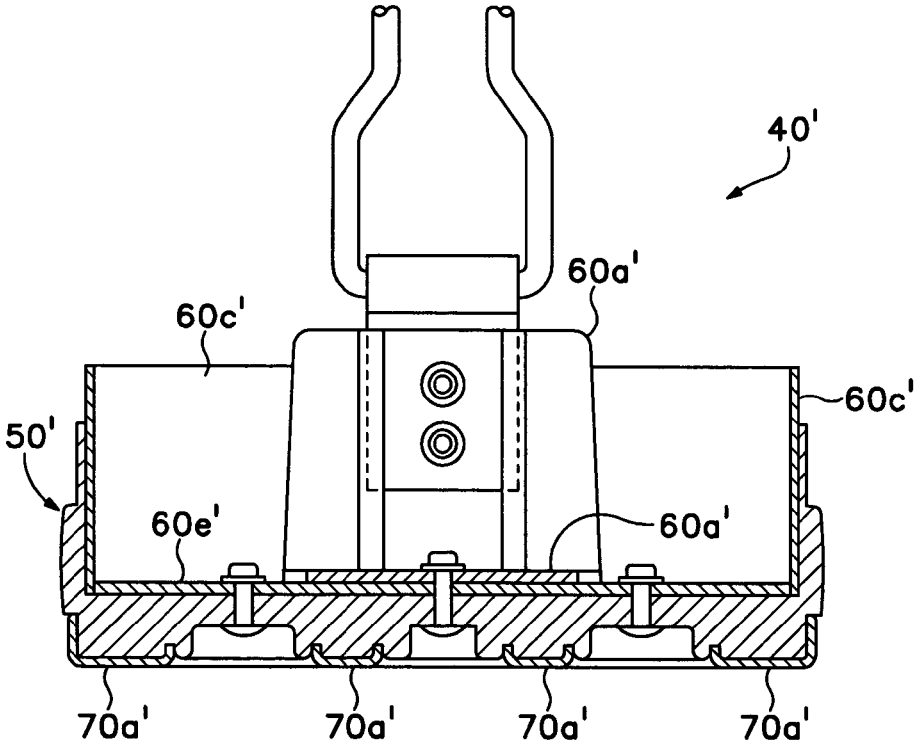
FIG. 14B is a cross-sectional view of the base depicted in FIG. 12, as defined along section line 14B-14B in FIG. 13.

The features of support assembly 30 described above permit golf bag 10 to stand in the upright position or in the inclined position. In the upright position, which is depicted in FIG. 3, a longitudinal axis 23 of body 20 is substantially perpendicular to the ground, legs 31 are positioned adjacent to the exterior surface of body 20, and golf bag 10 rests solely upon base 40. With regard to the configuration of base 40 in the upright position, substantially the entire lower surface of base 40 contacts and is parallel to the ground, and base 40 has the non-flexed configuration depicted in FIG. 5. In the inclined position, which is depicted in FIG. 4, longitudinal axis 23 of body 20 is obliquely-positioned with respect to the ground, legs 31 extend obliquely away from body 20, and golf bag 10 rests upon both base 40 and the ends of legs 31. With regard to the configuration of base 40 in the inclined position, a rear portion 41 of base 40 flexes or pivots upward with respect to a front portion 42 such that only front portion 42 remains in contact with the ground, as depicted in FIG. 6. Accordingly, base 40 flexes when golf bag 10 is placed in the inclined position.

The manner in which golf bag 10 is set upon the ground determines whether golf bag 10 stands in the upright position or the inclined position. When the individual intends to have golf bag 10 in the upright position, golf bag 10 is set upon the ground such that longitudinal axis 23 is perpendicular to the ground and substantially the entire lower surface of base 40 contacts the ground. This procedure ensures that the weight of golf bag 10, and the golf equipment contained by golf bag 10, are distributed to place golf bag 10 in the upright position. When the inclined position is desired, however, golf bag 10 may be set upon the ground such that the weight of golf bag 10 and the golf equipment are distributed over front portion 42 of base 40. This procedure causes body 20 to rotate forward, which causes rear portion 41 to pivot relative to front portion 42. As rear portion 41 pivots, actuator 33 induces an upward force in legs 31, thereby causing legs 31 to rotate outward from body 20. Accordingly, rotating body 20 forward causes base 40 to flex and causes legs 31 to rotate outward, which places golf bag 10 in the inclined position.

The configuration of golf bag 10 described above provides a structure that permits golf bag 10 to rest upon the ground in either the upright position or the inclined position. Base 40 is structured to flex and facilitate a change from the upright position to the inclined position. More specifically, base 40 provides the sole point of contact with the ground when golf bag 10 is in the upright position. When golf bag 10 is in the inclined position, however, base 40 flexes such that rear portion 41 pivots upward and the ends of legs 31 contact the ground. Accordingly, base 40 operates in conjunction with support assembly 30 to support golf bag 10 in either the upright or inclined position.

Base 40 includes a contact element 50 and a plurality of connecting elements 60*a*-60*f*, as depicted in FIGS. 5-11C. In general, contact element 50 is formed of a flexible material, such as a polymer foam, that extends substantially around and closes the lower end of body 20, thereby preventing golf equipment from extending through the lower end. Given that contact element 50 may be formed from a polymer foam, connecting elements 60*a*-60*f* reinforce or otherwise provide durable areas for securing base 40 to body 20 and support assembly 30. Each of contact element 50 and connecting elements 60*a*-60*f* will be discussed in greater detail below.

Contact element 50 includes a sidewall 51 and a support surface 52. Sidewall 51 is depicted as being formed integral with support surface 52, which enhances the durability of base 40. In further embodiments, however, sidewall 51 and support surface 52 may be formed as separate elements and subsequently joined together. Sidewall 51 extends upward from support surface 52, and support surface 52 extends across the area defined by sidewall 51, thereby forming a generally concave structure. Upper portions of sidewall 51 may have a reduced thickness in comparison to lower portions of sidewall 51, as depicted in the cross-sections of FIGS. 11A-11C. The reduced thickness may be utilized, for example, to compensate for the thickness of the materials of body 20 that extend over the upper portions of sidewall 51 and are stitched to sidewall 51. The lower portions of sidewall 51 are generally thicker than the upper portions, but may have an area 53 of reduced thickness on each side and positioned generally at the interface between rear portion 41 and front portion 42 to facilitate flexing or pivoting of rear portion 41 with respect to front portion 42. The upper edge of sidewall 51 may exhibit a planar configuration, or may be contoured. Similarly, the exterior surface of sidewall 51 may have a uniform appearance, or may be contoured for aesthetic or functional reasons. Accordingly, the specific configuration of sidewall 51 may vary significantly within the scope of the present invention.

Support surface 52 generally forms a lower surface of golf bag 10 and is positioned to contact the ground. As with sidewall 51, the thickness of support surface 52 is selected to facilitate flexing or pivoting of rear portion 41 with respect to front portion 42. In general, the portion of support surface 52 located adjacent the front and rear of golf bag 10 have a greater thickness than central portions. More specifically, an area 54 that forms the interface between rear portion 41 and front portion 42 has a greater thickness than other areas of support surface 52. The reduced thickness of area 54 provides greater flexibility in area 54 than in other areas of support surface 52, thereby promoting flex. In addition to the reduced thickness, an indentation 55 extends across support surface 52 at the interface between rear portion 41 and front portion 42, thereby forming a flexion line that also promotes pivoting of rear portion 41 with respect to front portion 42. Indentation 55 is depicted in the figures as having a curved or semi-circular shape, but may also have other shapes within the scope of the present invention.

In addition to facilitating flexing or pivoting of rear portion 41 with respect to front portion 42, the thickness of support surface 52 may also be selected to compensate for expected wear that may occur as golf bag 10 is utilized and repeatedly set upon the ground. The various ground surfaces that may come into contact with support surface 52 include, for example, concrete, rock, dirt, and grass. Accordingly, the overall thickness of support surface 52, particularly in areas that may experience the greatest degrees of wear, may range from 5 to 10 millimeters, for example. Depending upon the specific structure and the material utilized for contact element 50, however, the thickness may depart from this range.

The material forming contact element 50 may be a polymer foam that is shaped through a conventional casting process, wherein a mold is utilized to impart the desired configuration. In this regard, contact element 50 may be formed from materials that include polyurethane or ethylvinylacetate foam. A suitable hardness for the ethylvinylacetate foam may be, for example, in a range of 60-64 on the Asker C scale. These types of polymer foam have advantages over conventional materials utilized in a golf bag base, which are generally formed from dense, non-foamed polymer materials. Polymer foam materials attenuate impact forces and absorb energy when base 40 contacts the ground. When a full set of golf clubs and other golf equipment is contained by body 20, golf bag 10 may weigh in excess of 25 pounds. Accordingly, considerable forces may be developed when golf bag 10 is placed upon the ground. A polymer foam material may be utilized, therefore, to cushion or otherwise reduce such forces, thereby protecting the golf clubs and other golf equipment.

A further benefit of the polymer foam material relates to the stability and flexibility provided by base 40. The dense, non-foamed polymer materials incorporated into many of the conventional golf bag bases exhibit a relatively thin cross-section. Although the conventional base is lightweight, the polymer materials are generally non-flexible. The polymer foam of contact element 50, however, imparts sufficient stability while retaining flexibility. The property of flexibility is particularly suitable for contact element 50, which flexes as rear portion 41 pivots with respect to front portion 42. Although advantages are gained from utilizing a polymer foam for contact element 50, a variety of other materials, such as non-foamed polymers, may be utilized to form contact element 50.

Connecting elements 60*a*-60*f* reinforce or otherwise provide durable areas for securing base 40 to body 20 and support assembly 30. In addition, connecting elements 60*a*-60*f* may provide additional stability or rigidity to base 40.

Connecting element 60*a* is positioned within front portion 42 and provides a connector between actuator 33 and base 40. As depicted in the figures, connecting element 60*a* has a generally L-shaped configuration, with one segment extending along the interior of sidewall 51 and the other segment extending along the interior of support surface 52. Connecting element 60*a* also includes a connector that receives a lower end of actuator 33 and secures actuator 33 to base 40. A plurality of rivets or an adhesive, for example, may be utilized to secure connecting element 60*a* to contact element 50.

Connecting element 60*b* is positioned within rear portion 41 and provides a connector between frame 22 and base 40. As with connecting element 60*a*, connecting element 60*b* is depicted as having a generally L-shaped configuration, with one segment extending along the exterior of sidewall 51 and the other segment extending along the exterior of support surface 52. A rivet, for example, may extend through connecting element 60*b* and frame 22 to securely connect frame 22 to base 40. Whereas connecting element 60*a* is positioned adjacent the interior surface of contact element 50, contact element 60*b* is positioned adjacent the exterior surface. In order to provide a flush, finished appearance to the interface between connecting element 60*b* and contact element 50, an indentation may be formed in contact element 50 to receive connecting element 60*b*.

The materials that form a portion of body 20 may be secured to base 40 through stitching or adhesives, for example. As depicted in the figures, however, stitching is utilized. When contact element 50 is formed of a polymer foam material, the thread utilized to stitch the materials to contact element 50 may eventually cut or otherwise pull through the foam material. In order to provide reinforcement, therefore, connecting elements 60*c* and 60*d* extend at least partially around the upper edge of sidewall 51. Although a single connecting element may be utilized, connecting elements 60*c* and 60*d* are separated by a space that facilitates pivoting of rear portion 41 with respect to front portion 42.

Connecting elements 60*e* and 60*f* extend along the interior area of support surface 52. Each of connecting elements 60*e* and 60*f* may provide additional rigidity to base 40. In addition, connecting elements 60*e* and 60*f* may reinforce areas where the partition, which may extend between divider 21 and base 40 to separate the various golf clubs, is secured to base 40. Whereas connecting element 60*e* is positioned in front portion 42, connecting element 60*f* is positioned in rear portion 41. This configuration forms a space between connecting elements 60*e* and 60*f* to facilitate flexing of base 40. In some embodiments of the invention, connecting elements 60*e* and 60*f* may be omitted or reduced in size, particularly when no partition is present.

A variety of materials are suitable for connecting elements 60*a*-60*f*, including various polymers and metals. More particularly, connecting elements 60*a*-60*f* may be formed from a nylon, polypropylene, or polyurethane material, or connecting elements 60*a*-60*f* may be formed from a high flex modulus polyether block amide, such as PEBAX, which is manufactured by the Atofina Company. Polyether block amide provides a variety of characteristics that benefit the present invention, including high impact resistance at low temperatures, few property variations in the temperature range of −40 degrees Celsius to positive 80 degrees Celsius, resistance to degradation by a variety of chemicals, and low hysteresis during alternative flexure. Another suitable material for connecting elements 60*a*-60*f* is a blend of polyether block amide and nylon with 23% glass reinforcement. Furthermore, connecting elements 60*a*-60*f* may be formed from a polybutylene terephthalate, such as HYTREL, which is manufactured by E.I. duPont de Nemours and Company. Composite materials may also be formed by incorporating glass fibers or carbon fibers into the polymer materials discussed above in order to enhance the strength of connecting elements 60*a*-60*f*. A textile material may also be utilized alone or in conjunction with connecting elements 60*c* and 60*d*.

The specific configuration of base 40 disclosed above provides one example of the many base configurations that fall within the scope of the present invention. Referring to FIGS. 12-14B, another base 40' is illustrated. As discussed above, wear to base 40 may occur as golf bag 10 is utilized and repeatedly set upon the ground. Although the polymer foam material selected for base 40 may provide suitable wear-resistance, additional wear resistance may be added, as depicted with reference to base 40'. The primary components of base 40' are a contact element 50', connecting elements 60*a*'-60*f*, and a pair of wear elements 70*a*' and 70*b*'. Contact element 50' and connecting elements 60*a*'-60*f*' have the general configuration of contact element 50 and connecting elements 60*a*-60*f*. Accordingly, contact element 50' is formed of a polymer foam material and includes a sidewall 51' and a support surface 52'. Wear elements 70*a*' and 70*b*' are secured to support surface 52' in areas that experience relatively high degrees of wear. Portions of wear elements 70*a*' and 70*b*' may also extend onto sidewall 51'.

The configuration of base 40', and particularly the materials forming contact element 50' and wear elements 70*a*' and 70*b*', is analogous to a sole structure of a conventional article of athletic footwear. In general, a sole structure of athletic footwear includes a midsole and an outsole secured to a lower surface of the midsole. The midsole is formed of a polymer foam, such as ethylvinylacetate or polyurethane foam, that attenuates impact forces and absorbs energy as the sole structure is compressed against the ground. The outsole is formed of a rubber material that is generally considered to be highly wear-resistant and durable. Accordingly, the outsole is positioned to contact the ground. With respect to base 40', therefore, wear elements 70*a*' and 70*b*' may be positioned to contact the ground and provide the wear-resistant properties imparted by a conventional footwear outsole. In contrast with base 40, therefore, wear element 70*b*' extends over connecting element 60*b*'. The material forming wear elements 70*a*' and 70*b*' may be formed of materials that include carbon black rubber compound. Wear elements 70*a*' and 70*b*' may be secured to contact element 50' through a variety of conventional attachment techniques that utilize adhesives or mechanical fasteners.

Figure 15:
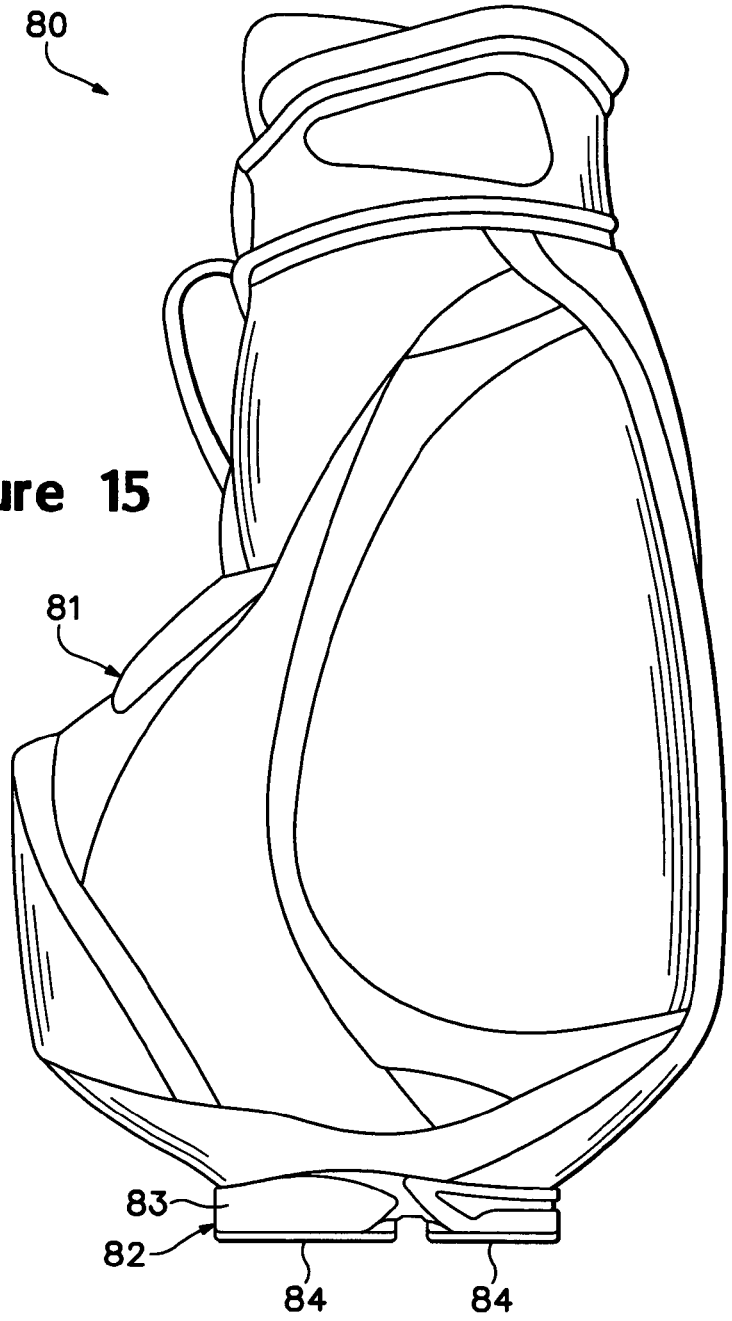
FIG. 15 is a side elevational view of another golf bag in accordance with the present invention.

A base having the general configuration of base 40 and base 40' may also be applied to other types of golf bags that do not include a support assembly. Referring to FIG. 15, a cart-style golf bag 80 is depicted. Golf bag 80 includes a body 81 and a base 82. The primary element of base 82 are a contact element 83, and base 82 may include a plurality of wear elements 84 that are secured to contact element 83. As with the prior embodiments, contact element 83 may be formed from a polymer foam, such as ethylvinylacetate or polyurethane foam, and wear elements 84 may be formed from carbon black rubber compound, for example. Accordingly, the general concept of utilizing a polymer foam with wear elements to form a golf bag base may be applied to a plurality of golf bag types.

Numerous modifications may be made to the configuration of base 40 and base 40' that are disclosed above. For example, sidewall 51 may include an indentation that circumscribes the upper surface of sidewall 51 and receives the material elements of body 20. Accordingly, the material elements may extend between the interior and exterior surface of sidewall 51. Frame 22 is disclosed as a single shaft that extends along a side of body 20, but may have the configuration of multiple stay rods that extend between divider 21 and base 40. A plurality of stay sockets that receive the stay rods may, therefore, be molded into base 40. In some embodiments, an internal frame may extend around base 40 to provide additional stability. Furthermore, additional connecting elements may be added to base 40 to connect partitions that separate golf club shafts.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A golf bag configurable to stand in an upright position or an inclined position, the golf bag comprising:

a substantially hollow body with a first end for receiving golf equipment and an opposite second end;

a base secured to the second end of the body;

a support assembly secured to the body and the base, the support assembly including a pair of legs for supporting the golf bag in the inclined position; and a frame that is separate from the support assembly and extends between the first end and the base, the frame including a single shaft;

wherein the single shaft comprises a first curved area positioned proximal the first end to form a handle, and a separate second curved area positioned in a lower portion of the golf bag; and wherein the separate second curved area has a first portion that extends away from the body as the shaft extends toward the second end of the body and a second portion that extends toward the body as the shaft extends toward the second end of the body.

2. The golf bag recited in claim 1, wherein the shaft includes a curved area positioned proximal the first end to form a handle.

3. The golf bag recited in claim 1, wherein the base includes a one-piece element that extends substantially around the second end of the body and forms a support surface for contacting a ground.

4. The golf bag recited in claim 1, wherein the base is formed of a flexible polymer foam material, a first portion of the base being pivotable with respect to a second portion of the base about the flexion line.

5. The golf bag recited in claim 1, wherein an end of the shaft is secured to a divider that is positioned at the first end, and an opposite end of the shaft is secured to the base.

6. The golf bag recited in claim 1, wherein the separate second curved area in the lower portion of the golf bag extends into material elements forming the body to support a shape of the material elements.

7. A golf bag comprising:

a substantially hollow body with a first end for receiving golf equipment and an opposite second end;

a base secured to the second end of the body; and a frame formed as a single shaft that extends between the first end and the base, the frame including a first curved area positioned proximal the first end to form a handle, and the frame including a separate second curved area positioned proximal the second end and having at least a portion extending away from the body;

wherein the shaft is connected at an exterior of the body at the first end of the body and at the second end of the body;

wherein the body is at least partially formed of material elements, and wherein the second curved area supports a shape of the material elements that form at least one pocket in the body.

8. The golf bag recited in claim 7, wherein the second curved area is positioned within the body.

9. The golf bag recited in claim 7, further including a support assembly secured to the body and the base, the support assembly including a pair of legs for supporting the golf bag in the inclined position.

10. The golf bag recited in claim 9, wherein the base includes a one-piece element that extends substantially around the second end of the body and forms a support surface for contacting a ground.

11. The golf bag recited in claim 10, wherein the base is formed of a flexible polymer foam material, a first portion of the base being pivotable with respect to a second portion of the base about the flexion line.

12. The golf bag recited in claim 7, wherein the base includes a one-piece foam element that extends substantially around the second end of the body and forms a support surface for contacting a ground.

13. The golf bag recited in claim 12, wherein the base defines a flexion line, a first portion of the base being pivotable with respect to a second portion of the base about the flexion line.

14. The golf bag recited in claim 12, wherein at least one wear element is secured to an exterior surface of the foam element, the at least one wear element being positioned to contact a ground.

* * * * *